US005989114A

United States Patent [19]

Donahue et al.

[11] Patent Number: 5,989,114

[45] Date of Patent: Nov. 23, 1999

[54] COMPOSITE GRINDING AND BUFFING DISC WITH FLEXIBLE RIM

[75] Inventors: Allen Thomas Donahue, Janesville, Wis.; Douglas Remi Stitt, South Beloit, Ill.

[73] Assignee: Unova IP Corp., Woodland Hills, Calif.

[21] Appl. No.: 08/955,356

[22] Filed: Oct. 21, 1997

[51] Int. Cl.[6] ..... B24B 33/00

[52] U.S. Cl. ..... 451/548; 451/542; 451/543; 451/544

[58] Field of Search ..... 454/548, 542, 454/540, 57, 58

[56] References Cited

U.S. PATENT DOCUMENTS

| | | | |
|---|---|---|---|
| 254,001 | 2/1882 | Hofstad . | |
| 1,318,630 | 10/1919 | Waugh . | |
| 2,309,016 | 1/1943 | Ryan . | |
| 2,451,295 | 10/1948 | Metzger et al. . | |
| 2,726,495 | 12/1955 | Field . | |
| 2,997,820 | 8/1961 | Skoog | 451/541 |
| 4,338,748 | 7/1982 | Elbel . | |

FOREIGN PATENT DOCUMENTS

| | | | |
|---|---|---|---|
| 348889 | 10/1960 | Switzerland | 451/541 |
| 536954 | 11/1976 | U.S.S.R. | 451/541 |

OTHER PUBLICATIONS

Product Analysis, Chemir/Polytech Laboratories, Inc., Purchase Order #533, Mar. 8, 1996.

*Primary Examiner*—Robert A. Rose
*Assistant Examiner*—George Nguyen
*Attorney, Agent, or Firm*—Hoffman, Wasson & Gitler

[57] ABSTRACT

A unitary composite abrasive disc for one-pass grinding and finishing of a workpiece comprising a flexible epoxy rim bonded to a rigid core.

22 Claims, 3 Drawing Sheets

COMPOSITE GRINDING AND BUFFING DISC WITH FLEXIBLE RIM

BACKGROUND OF THE INVENTION

1. Field of Art

The invention relates to a composite disc grinding wheel for one-pass grinding and finishing of a workpiece. In particular, the invention relates to a conventional resin-bonded abrasive grinding wheel modified with flexible annular rim comprising an epoxy resin bond containing abrasive grain selected for the desired finish on the workpiece.

2. Description of Related Art

Workpieces shaped by grinding or cutting with conventional disc grinders are typically finished by hand-buffing, as buffing tools equipped with non-woven abrasive pads formulated to achieve a desired finish on the workpiece.

The desirability of providing a single composite abrasive disc to perform both grinding and finishing tasks has been recognized. U.S. pat. No. 254,011 to Hofstad; U.S. Pat. No. 2,309,016 to Ryan; and U.S. Pat. No. 2,451,295 to Metzger et al are representative. Such wheels however comprise separatable abrasive bodies concentrically mounted on a central supporting body affixed to a drive shaft. A variation of such combined abrading and polishing tools is described in U.S. Pat. No. 2,726,495 to Field, comprising a series of laminated discs having an abrasive coating for cutting the workpiece and a cloth backing for buffing it; when the periphery of the laminate is applied to the workpiece, the buffing and cutting layers are simultaneously applied to the workpiece.

SUMMARY OF THE DISCLOSURE

The invention comprises a unitary composite grinding and buffing disc having a rigid abrasive core containing abrasive grain for grinding or cutting a workpiece, and a flexible resin-bonded annular rim containing abrasive grain united to the core for buffing or polishing the workpiece. Preferably, the core comprises a conventional grinding disc or wheel, and the rim comprises a flexible epoxy-resin bond containing abrasive grain for finishing the workpiece. The disc permits a workpiece to be ground and polished in one pass of the disc.

Detailed Description of the Invention

Figure 1A:
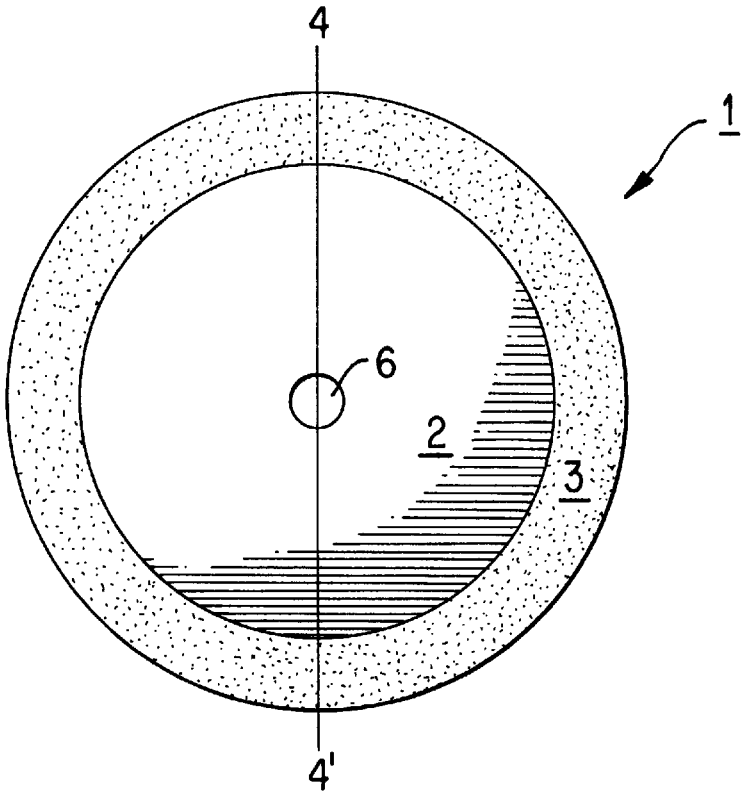
FIG. 1A is a schematic front elevation of the grinding face of an abrasive disc according to the invention and FIGS. 1B and 1C illustrate two different cross-sections of the disc of FIG. 1 along the line 4–4'.
Figure 1B:
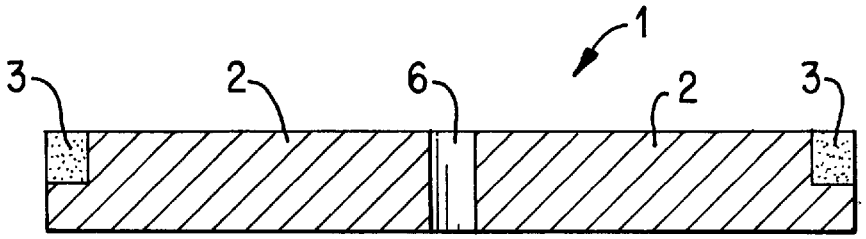
Figure 1C:
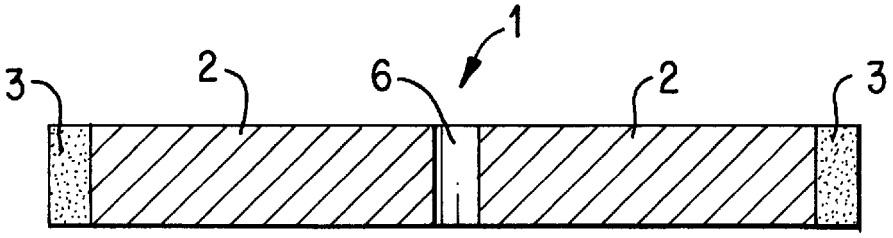
Figure 2A:
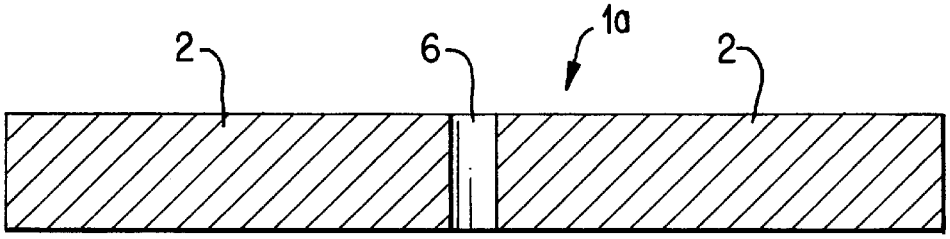
FIG. 2 illustrates a conventional grinding disc (2A) trued to accept a flexible rim (2B) and set into a mold (2C) for forming the flexible rim.
Figure 2B:
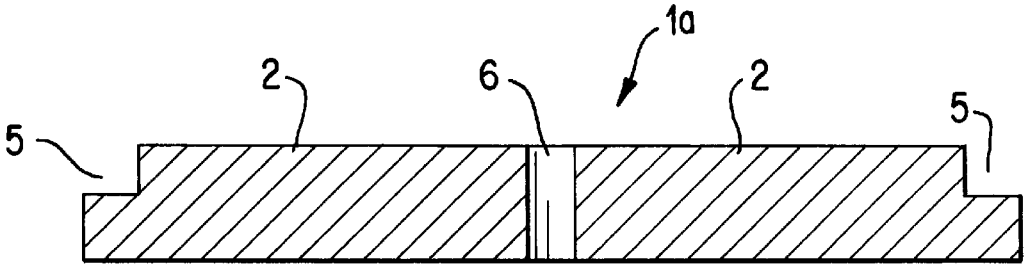
Figure 2C:
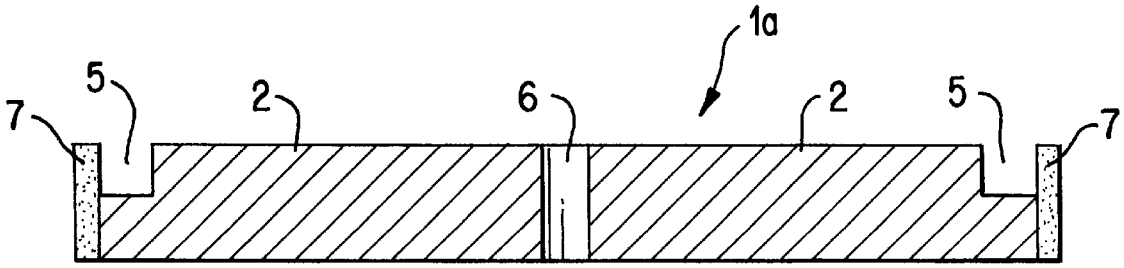

FIGS. 1 and 2 illustrate a nut-inserted abrasive disc according to the invention generally indicated at 1, including an abrasive disc core 2 having bonded thereto a flexible epoxy resin rim 3 containing abrasive in an amount and of a type suitable for achieving the desired finish on a selected workpiece. The disc also includes a central bore 6 for mounting the disc for use as known in the art.

The core 2 of the disc 1 may be prepared as known in the art by uniformly admixing a curable liquid abrasive composition contained abrasive grain and optional conventional fillers and/or other modifying agents to form a customary curable core abrasive composition, followed by molding, compacting, and curing the mixture. Typical core compositions comprise inorganic settable cements, organic resins, and vitrified bonds, such as magnesium oxychloride, phenolic resins, and rigid epoxy compositions. Any conventional abrasive grain suitable for the intended grinding application in the selected bond may be used. Typical useful abrasive grains include fused alumina or zirconia, silicon carbide and green silicon carbide, garnet, and diamond. As also known in the art, the core may further contain friable abrasive granules to create porosity at the working surface of the disc, such as glass or metal micro balloons, expanded minerals, lightweight crystals, and glass beads. The core may also contain customary fillers, especially metal, resin, or glass fibers and mineral fillers such as cryolite or clay.

In preferred embodiments of the invention, the core binder is a phenolic resin, typically incorporated into the mixture as a powder premixed with other dry ingredients, followed by addition of solvents or curing agents; Varcum (Oxychemical Co.) and Durite (Borden) are exemplary. Other suitable organic binders for the core 2 include urea-formaldehyde resins, melamine-formaldehyde resins, polyester resins, and alkyd resins.

The flexible rim resin composition comprises an uncured epoxy resin in liquid form, e.g., a resin having a molecular weight, for example, up to about 20 repeating units, curable to the desired flexibility for the intended application. Commercial epoxies such as those manufactured under the trademarks "Epi-Rez", "Epon", "Epikote", "DER", or "Araldite" are exemplary, as are epichlorohydrin/bisphenol-A reaction products. The curable rim composition further essentially includes appropriate curing agents for the epoxy such as amines, polyamides and acid anhydrides, and one or more conventional abrasive grains suitable for applying the desired finish to the workpiece. Exemplary useful abrasives for the rim composition comprise the abrasive grains described above for the abrasive core, particularly fused alumina and silicon carbide. For the core composition, coarse grain suitable for cutting or grinding the workpiece is used, such as 36–50 grit (American Grain Association—AGA); for the rim composition, finer grains are preferably used to obtain a smooth finish on the workpiece, for example 60–500 grit (AGA). The amount of grain used in the rim bond is that sufficient to abrade the workpiece to the desired finish.

The rim composition further preferably includes friable granules as described above, selected for imparting a specific type of finish to the workpiece. For example, materials such as coarse ceramic bubbles or glass frit can be used to give a matte or brushed finish to a metal workpiece. Cork particles, corncob particles, or walnut shells (flexible) are useful for a bright finish, as are other materials. Various abrasive friable materials of either type may be selected for the desired finish; such friable materials are known in the art for use in conventional rigid cores to assist in grinding.

In a typical process for forming the abrasive disc of the invention, a liquid epoxy resin such as described above is applied to the rim of a fully cured rigid core, followed by curing of the epoxy to form a grinding and buffing disc as illustrated in FIG. 1. FIG. 1A shows the grinding face of the disc 1 comprising a rigid core 2 having a central bore 6 for mounting the disc 1 and a flexible rim 3 according to the invention. As illustrated in FIGS. 1A and 1B, which show cross-sections of the disc of FIG. 1, the rim 3 may be partially (FIG. 1B) or fully (FIG. 1C) disposed around the periphery of the disc 1.

The core 2 is first mixed, molded, pressed, and fully cured or fired, as usual. In the embodiment of FIG. 2, the cured core 2 is then relief-cut around its outside periphery to form an annular groove 5 to accommodate the rim 3. The groove is cut to the width and depth desired for the flexible rim component of the disc. For a disc having an OD of from about 15" to 42", the flexible rim width is typically about ½ to 3". The particular rim width is usually determined by, although not limited by, the size of the part being ground; the rim width is typically as wide as 1½ to 2 times the width of the part for most applications. The thickness (depth) is generally selected for the amount of buffing contemplated for a given workpiece.

After trueing the disc to accommodate the desired rim, the wheel is positioned inside a mold 7, and liquid epoxy resin poured into the mold around the outer rim of the wheel, and cured in situ to form a disc such as shown in FIGS. 1A and 1B.

The disc may be cut with any useful tool such as star cutters, cone cutters or diamond dressing tools. Instead of cutting the cavity for the flexible rim, the cavity may be molded into the wheel (not illustrated).

Figure 3A:
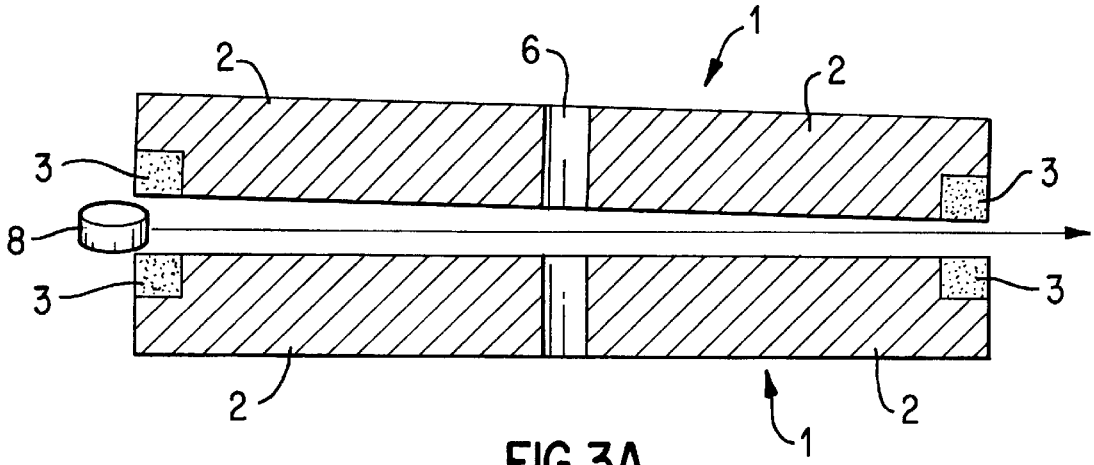
FIG. 3 illustrates double-disc (3A) and single-disc (3B) applications employing discs according to the invention.
Figure 3B:
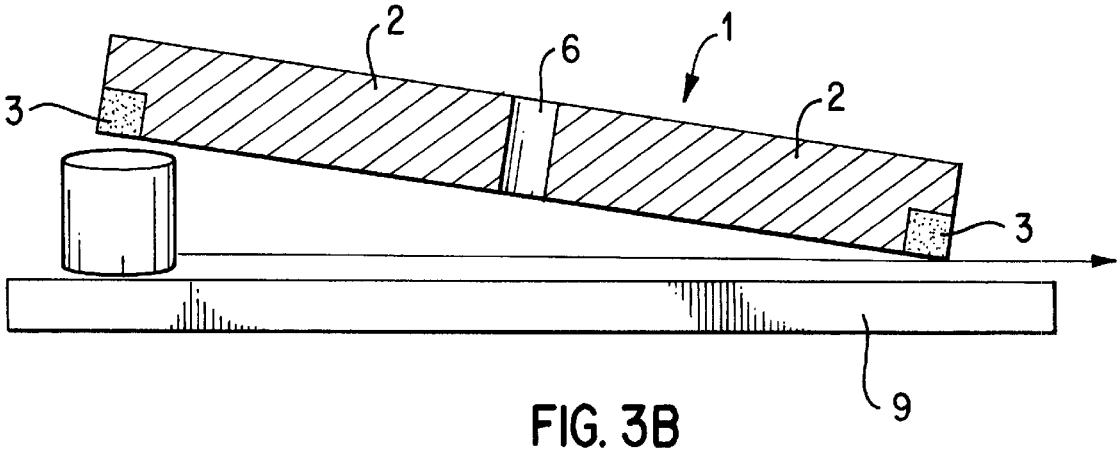

The discs of the invention particularly include abrasive wheels including nut inserted discs for grinding and finishing metal workpieces such as hand tools, e.g., wrenches or pliers; compressor valve plates; or automotive parts. They are broadly useful for grinding off stock and imparting a desired finish to the product in one pass. In one particular useful application, the discs of the invention are employed in double disc or single disc grinding as illustrated in FIG. 3. In FIG. 3A, a workpiece 8 is passed between the discs 1 where it is ground on two surfaces by the cores 2 and finished by the rim 3 just before it is ejected. In the apparatus of FIG. 3B, a workpiece 8*a* is passed between a disc 1 and a supporting base 9 where it is ground on one surface by the core 2, and finished by the rim 3. The discs of FIG. 1C may also be used in these and other conventional disc grinding application.

EXAMPLES

Example 1

Polishing Rim for "Brushed" Finish

A nut inserted disc wheel of dimension 18" OD 2" thick and 3" ID comprising a phenolic resin binder and aluminum oxide grain was mixed and cured. The wheel was then trued from the 18" diameter to the 12" diameter 1½ deep. The wheel was wrapped with a steel mold band and the flexible epoxy rim was poured into this cavity. The flexible rim was composed of:

54 oz 60 grit silicon carbide 21 oz aluminum oxide bubbles, 36 mesh 20 oz Dow epoxy resin 331

18 oz polyamide resin (curing agent)

78 cc γ-butyrolactone solvent

The above mixture was allowed to cool at room temperature for six hours and was then post-cured at 240° F. for four hours. The wheel was allowed to cool and was then trued, and speed tested to 1½ operating speed.

Example 2

Polishing Rim for "Bright" Finish

A nut inserted disc wheel of dimension 30" OD 2" thick and 10" ID comprising phenolic resin binder and aluminum oxide grain was mixed and cured. The wheel was then trued from the 30" diameter to the 28" diameter 2" deep. The wheel was wrapped with a steel mold band and the flexible epoxy rim was poured into this cavity. The flexible rim was composed of:

84 oz 220 grit brown aluminum oxide 68 oz 220 grit black silicon carbide 4 oz 20/40 mesh ground cork 56 oz Dow epoxy resin 331

50 oz polyamide resin (curing agent)

212 cc γ-butyrolactone solvent

The above mixture was allowed to cool at room temperature for six hours and was then post cured at 240° F. for four hours. The wheel was allowed to cool and was then trued, and speed tested to 1½ operating speed.

What is claimed is:

1. A unitary composite abrasive disc for one-pass grinding and finishing of a workpiece comprising a bonded abrasive core formulated for grinding the workpiece and an annular rim bonded to the core comprising a resin bond more flexible than the core bond and consisting of an epoxy resin, containing abrasive grain for finishing the workpiece.

2. The composite abrasive disc of claim 1, wherein the core is an organic resin-bonded core.

3. The composite abrasive disc of claim 2, wherein the core is a phenolic resin-bonded core.

4. The composite abrasive disc of claim 1, wherein the rim is bonded to the core by applying a curable liquid epoxy resin to the cured core and curing the resin in situ to form the composite abrasive disc.

5. The composite abrasive disc of claim 1, wherein the rim comprises an epoxy resin binder, abrasive grain in an amount sufficient to finish the workpiece, and friable abrasive granules.

6. The abrasive disc of claim 5, wherein the friable granules comprise particles of a material which provide a bright finish.

7. The abrasive disc of claim 6, wherein the material is cork, corncob, or walnut shells.

8. The abrasive disc of claim 5, wherein the friable granules comprise particles of a material which provide a matte finish.

9. The abrasive disc of claim 8, wherein the particles are coarse ceramic bubbles or glass frit.

10. The abrasive disc of claim 1, wherein the abrasive grain in the epoxy bond is a finer grit than that in the core.

11. The abrasive disc of claim 1, wherein the abrasive grain in the epoxy bond is of a size from about 60–500 grit (AGA).

12. The abrasive disc of claim 11, wherein the abrasive core contains abrasive grains of a size from about 30–50 grit (AGA).

13. The composite abrasive disc of claim 12, wherein the core contains friable granules comprising hollow bodies of glass, alumina or zirconia.

14. A one-pass method for simultaneously grinding and finishing a workpiece comprising passing the workpiece across and against the rotating disc of claim 1 to shape and finish the workpiece.

15. The method of claim 14, wherein the core is a resin-bonded core.

16. The method of claim 14, wherein the rim is bonded to the core by applying a curable liquid epoxy resin to the periphery of the cured core and curing the epoxy resin in situ to form the composite abrasive disc.

17. The method of claim 15, wherein the core is a cured phenolic-resin bonded core.

18. The method of claim 14, wherein the rim comprises an epoxy resin binder, abrasive grain in an amount sufficient to finish the workpiece, and friable abrasive granules.

19. The method of claim 18, wherein the friable granules comprise particles of a material which provide a bright finish.

20. The method of claim 19, wherein the material is cork, corncob, or walnut shells.

21. The method of claim 18, wherein the friable granules comprise particles of a material which provide a matte finish.

22. The method of claim 21, wherein the particles are coarse ceramic bubbles or glass frit.

* * * * *